US008100709B2

(12) United States Patent
Zhang

(10) Patent No.: US 8,100,709 B2
(45) Date of Patent: Jan. 24, 2012

(54) ELECTRICAL CONNECTOR HAVING IMPROVED LATCHING MEMBERS

(75) Inventor: Xiao-Kang Zhang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/777,281

(22) Filed: May 11, 2010

(65) Prior Publication Data

US 2010/0285684 A1 Nov. 11, 2010

(30) Foreign Application Priority Data

May 11, 2009 (CN) ..... 200920303016.4

(51) Int. Cl.
*H01R 13/627* (2006.01)

(52) U.S. Cl. ..... 439/353

(58) Field of Classification Search ..... 439/353, 439/357, 607.48, 607.41, 607.43
See application file for complete search history.

(56) References Cited

U.S. PATENT DOCUMENTS

| | | | | |
|---|---|---|---|---|
| 6,865,369 | B2 * | 3/2005 | Semmeling et al. | 434/357 |
| 6,866,535 | B2 * | 3/2005 | Uchida | 439/357 |
| 6,913,485 | B2 * | 7/2005 | Ko | 439/579 |
| 6,997,733 | B2 * | 2/2006 | Peng | 439/353 |
| 7,175,465 | B1 * | 2/2007 | Tsai | 439/352 |
| 7,258,565 | B2 * | 8/2007 | Huang et al. | 439/353 |
| 7,329,154 | B2 | 2/2008 | Koyama | |
| 7,422,465 | B2 * | 9/2008 | Watanabe et al. | 439/353 |
| 7,465,194 | B1 * | 12/2008 | Ho et al. | 439/607.01 |
| 7,604,496 | B2 | 10/2009 | Takeuchi et al. | |
| 7,628,638 | B2 * | 12/2009 | Wu | 439/358 |
| 2010/0285683 | A1 * | 11/2010 | Zhang | 439/357 |

* cited by examiner

*Primary Examiner* — Tulsidas C Patel
*Assistant Examiner* — Harshad Patel
(74) *Attorney, Agent, or Firm* — Ming Chieh Chang; Wei Te Chung; Andrew C. Cheng

(57) ABSTRACT

An electrical connector (100) for mating with a mating connector (700) along a mating direction includes an insulative housing (1) defining a passageway and a pair of latching members (2) inserted in the passageway. Each latching member has a resisting portion (21) and a latching portion (22) extending forwardly from the resisting portion and deformable from a first position to a second position for latching with the mating connector. The resisting portion includes an upper section (211) and a lower section formed at opposite sides of the latching portion and respectively abutting against the insulative housing along the mating direction when the latching portion is located in the second position.

8 Claims, 6 Drawing Sheets

ELECTRICAL CONNECTOR HAVING IMPROVED LATCHING MEMBERS

CROSS-REFERENCE TO RELATED APPLICATIONS

This patent application is a related application of a copending application entitled "ELECTRICAL CONNECTOR HAVING IMPROVED LATCHING MEANS", which is invented by the same inventor as this patent application and assigned to the same assignee with this application.

BACKGROUND OF THE INVENTION

1. Field of the Invention

The present invention relates to a connector, and more particularly to an electrical connector having a pair of latching members protected from being destroyed.

2. Description of Related Art

U.S. Pat. No. 7,604,496 issued to Takeuchi et al. on Oct. 20, 2009 discloses an electrical connector comprising an insulative housing having a base and a tongue portion, a plurality of contact terminals assembled to the insulative housing, a pair of latching members mounted at opposite sides of the insulative housing, a cable assembly electrically connected with the contact terminal, and a shielding shell attached to the insulative housing. The latching member is formed with a body portion, a cantilevered arm extending forwardly from an upper portion of the body portion, a fixing portion extending forwardly from a lower portion of the body portion, and a regulating portion extending rearwardly then upwardly from a rear portion of the body portion and resisting against the insulative housing at a height direction.

When the mating connector is mating with the electrical connector, the force generated in the mating process would be transmitted through the cantilevered arm to the body portion and the regulating portion. Providing such a regulating portion on the latching member is a hard job.

Hence, an electrical connector having improved latching members is highly desired.

SUMMARY OF THE INVENTION

Accordingly, an object of the present invention is to provide an electrical connector having a latching member protected from being destroyed and easy to be configured.

In order to achieve the object set forth, an electrical connector mating with a mating connector along a mating direction in accordance with the present invention includes an insulative housing defining a passageway and a pair of latching members inserted in the passageway of the insulative housing. Each latching member has a resisting portion and a latching portion extending forwardly from the resisting portion and deformable from a first position to a second position for latching with the mating connector. The resisting portion includes an upper section and a lower section formed at opposite sides of the latching portion and respectively abutting against the insulative housing along the mating direction when the latching portion is located in the second position.

A force generated in the mating process is transmitted through the cantilevered beam to the upper section above the cantilevered beam and the lower section below the cantilevered beam. Compared to the latching member having the lower section only, the force generated in the instant invention could be dispersed to opposite sides of the cantilevered beam and has been weakened. The latching portion of the latching member is protected from being broken off from the resisting portion under a weakened force. Such an upper section and a lower section of the resisting portion are easy to form.

Other objects, advantages and novel features of the invention will become more apparent from the following detailed description when taken in conjunction with the accompanying drawings.

DETAILED DESCRIPTION OF THE PREFERRED EMBODIMENT

Figure 1:
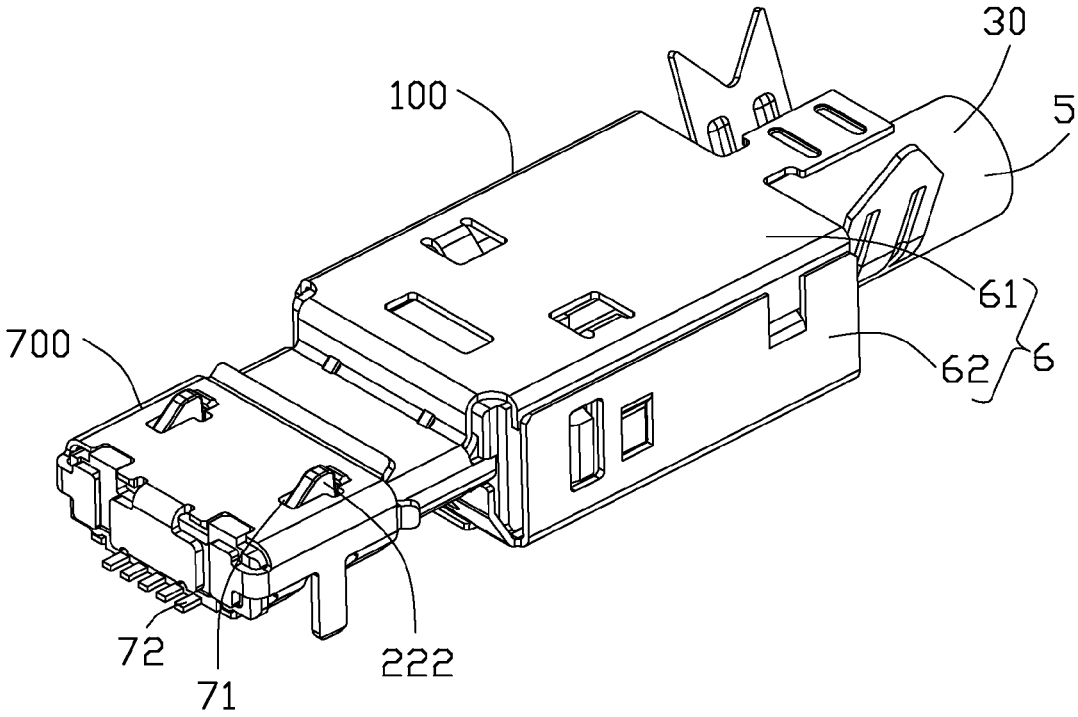
FIG. 1 is an assembled perspective view showing an electrical connector and a mating connector in accordance with the present invention.

Reference will now be made in detail to the preferred embodiment of the present invention. Referring to FIGS. 1-4, an electrical connector 100 mating with a mating connector 700 comprises an insulative housing 1, a pair of latching members 2 mounted in the insulative housing 1, a cable assembly 30 assembled to the insulative housing 1, and a shielding shell 6 attached to the insulative housing 1. The mating connector 700 comprises a housing (not labeled) defining a pair of latching recesses 71 and plurality of mating contacts 72 received in the housing.

Figure 4:
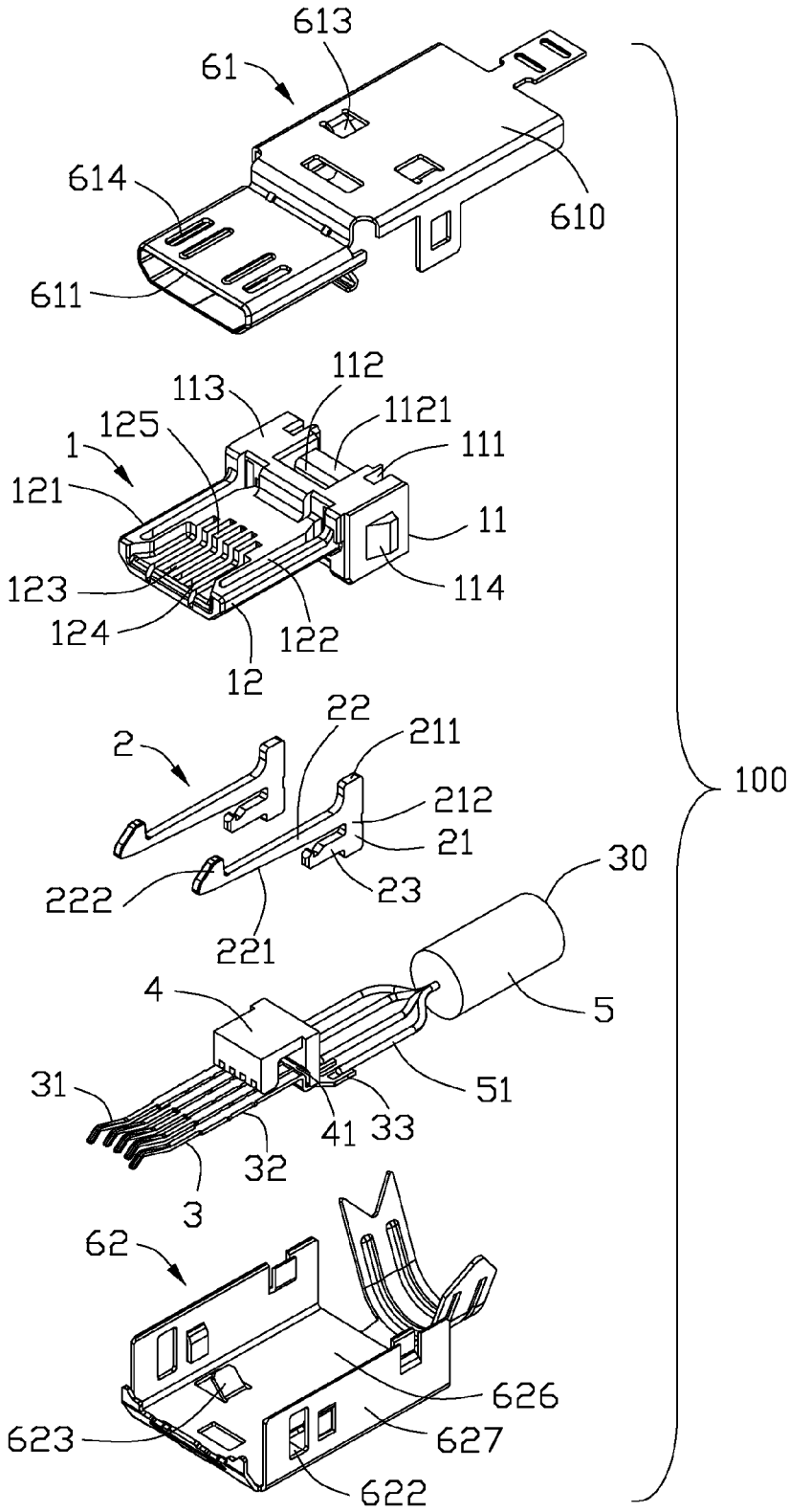
FIG. 4 is an exploded perspective view showing the electrical connector.

Referring to FIG. 4, the insulative housing 1 comprises a base portion 11 and a tongue portion 12 extending forwardly from the base portion 11. The base portion 11 comprises a pair of resisting walls 113 and a plunging recess 112 defined between the pair of resisting walls 113. Each resisting wall 113 has a securing recesses 111 defined along a rear surface thereof and a protrusion 114 protruding from a side face thereof. In conjunction with FIG. 5, the base portion 11 has a resisting face 115 formed in each securing recess 111 and facing toward the securing recess 111. The base portion 11 has a block 1121 formed in the plunging recess 112 and connected with the pair of resisting walls 113.

The tongue portion 12 has a pair of ribs 121 formed at a lower surface of the tongue portion 12, a stepped portion 125 between the pair of ribs 121, and a concave portion 124 defined at a front portion of the stepped portion 125. Each rib 121 is formed with an elongated inserting recess 122. The tongue portion 12 has a plurality of contact recesses 123 defined at the concave portion 124 and the stepped portion 125.

Each latching member 2 comprises a vertical resisting portion 21, a latching portion 22 substantially perpendicular to the resisting portion 21, and a barb portion 23 substantially parallel with the latching portion 22. The resisting portion 21 has a body portion 212 and a thumb portion 211 formed at a top end of the body portion 212. The latching portion 22 is connected to the resisting portion 21 at a root portion 223 between the body portion 212 and the thumb portion 211. The latching portion 22 is formed with a resilient beam 221 and a hook portion 222 formed at a free end of the resilient beam 221.

The cable assembly 30 comprises an organizer 4, a plurality of contact terminals 3, and a cable 5 having a plurality of conductive portions 51. The contact terminals 3 and the conductive portions 51 of the cable 5 are connected with each other in the organizer 4. Each contact terminal 3 is formed with a contact portion 31. The organizer 4 has a opening 41 defined therein. Each contact terminal 3 comprises a contact portion 31, a soldering portion 33 and an intermediate portion 32 between the contact portion 31 and the soldering portion 33.

The shielding shell 6 comprises an upper shell 61 and a lower shell 62 cooperated with each other. The upper shell 61 comprises an upper wall 610 and a capsulate portion 611 connected with the upper wall 610. The upper wall 610 is formed with a pair of downwardly extending upper blocking plates 613. The capsulate portion 611 has a pair of channels 614 defined thereon.

The lower shell 62 comprises a bottom wall 626 and a pair of side walls 627. The lower shell 62 is formed with a pair of upwardly extending lower blocking plates 623. The side wall 627 has a pair of locking holes 622 formed thereon.

Referring to FIGS. 2-5, in assembling of the electrical connector 100, the organizer 4 is received in the plunging recess 112 of the insulative housing 1, with the block 1121 plunged in the opening 41 of the organizer 4. The contact terminals 3 are inserted in the contact recesses 123, with the contact portions 31 exposed in the concave portion 124 of the insulative housing 1. The pair of latch members 2 are received in the inserting recesses 122 of the insulative housing 1. The resisting portion 21 of the latching member 2 is disposed in the securing recess 111 of the insulative housing 1 and the barb portion 23 has an interference with an interfering hole 13 defined in the base portion 11.

The upper shell 61 and the lower shell 62 are cooperated with each other to enclose the insulative housing 1, with the capsulate portion 611 enclosing the tongue portion 12. The upper blocking plate 613 and the lower blocking plate 623 are respectively positioned behind the thumb portion 211 and the root portion 212. The hook portions 222 tilt upwardly from the inserting recesses 122 and are slidable in the channels 614 of the upper shell 61. The protrusions 114 of the insulative housing 1 engage with the locking holes 622 of the lower shell 62.

Figure 2:
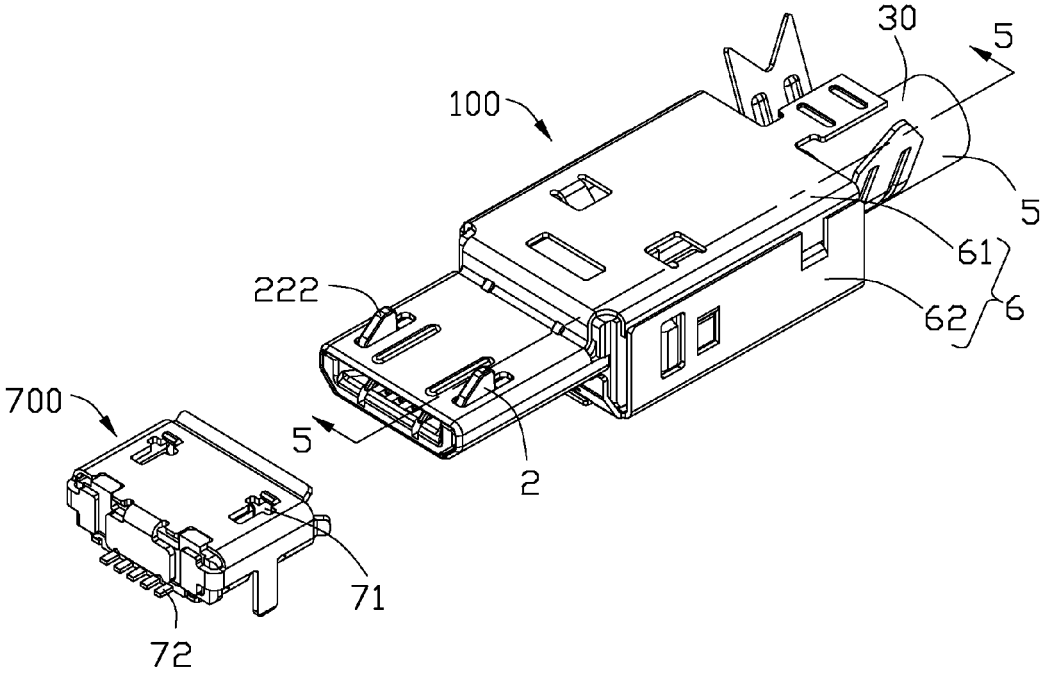
FIG. 2 is a perspective view showing the assembled electrical connector and the mating connector separating from the electrical connector.
Figure 3:
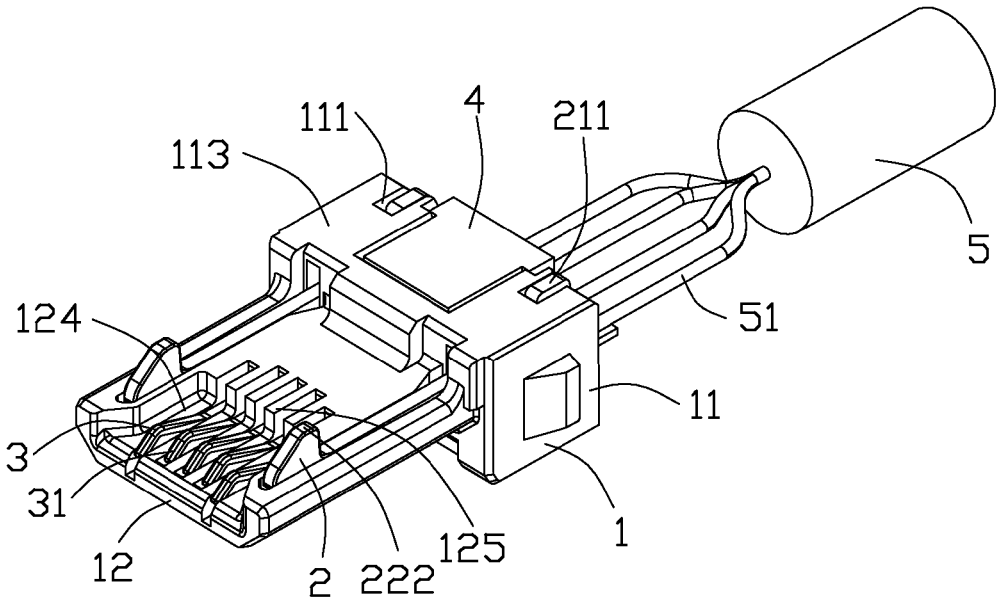
FIG. 3 is a partially exploded perspective view showing the electrical connector, with a shielding shell being removed.
Figure 5:
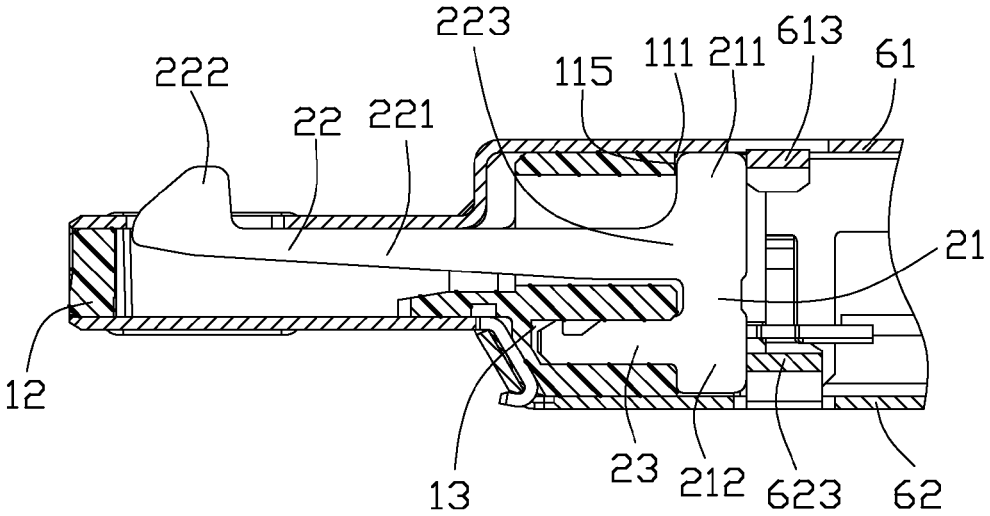
FIG. 5 is a cross-sectional view of the electrical connector, taken along line 5-5 of FIG. 2, when a mating connector has not been mated with the electrical connector.

Referring to FIGS. 2 and 5, when the mating connector 700 has not been matted with the electrical connector 100, the thumb portion 211 of the latching member 2 is received in the securing recess 111.

Figure 6:
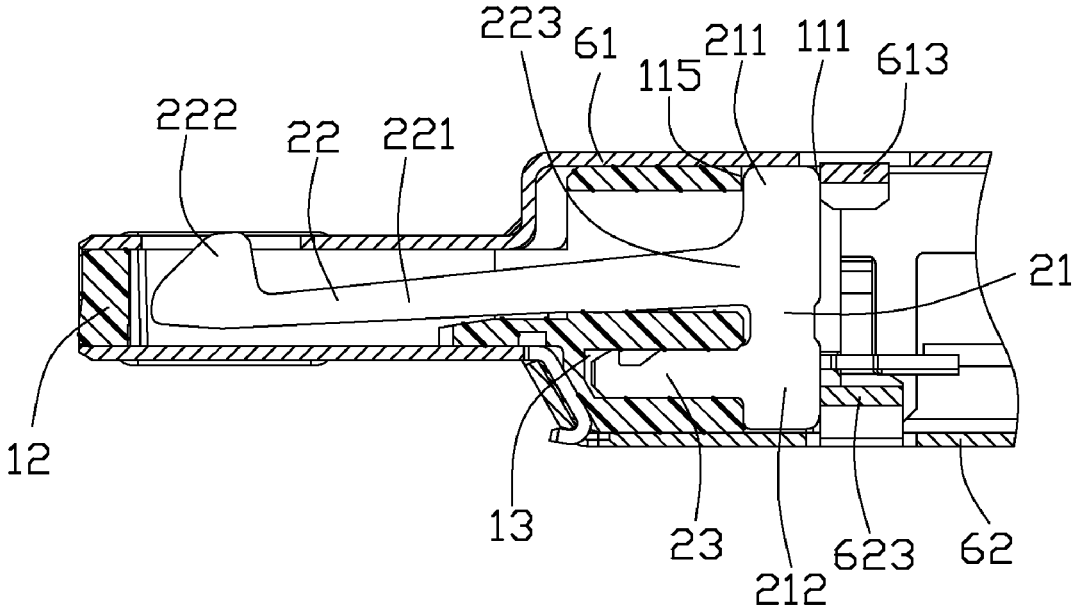
FIG. 6 is a cross-sectional view similar to FIG. 5, when the mating connector is mating with the electrical connector.

Referring to FIG. 6, when the mating connector 700 is matting with the electrical connector 100 in a mating process, the hook portion 222 of each latching member 2 is depressed by the mating connector 700 under an exerted force. The cantilevered beam 221 of the each latching member 2 moves downwardly. The thumb portion 211 abuts against the resisting face 115.

Referring to FIGS. 1 and 5, when the mating connector 700 is completely mated with the electrical connector 100, the hook portion 222 of the latching member 2 engages with the latching recess 71 of the mating connector 700. The cantilevered beam 221 restores upwardly. The thumb portion 211 has a rearwardly moving trend and is blocked by the upper blocking plate 613.

During the mating process, the thumb portion 211 abuts against the resisting face 115 and the exerted force is transmitted through the cantilevered beam 221 to the body portion 212 and the thumb portion 211. The force is dispersed to the body portion 212 below the cantilevered beam 221 and the thumb portion 211 above the cantilevered beam 221, rather than be concentrated in the root portion 223 of the cantilevered beam 221. The latching portion 22 of the latching member 2 is protected from being broken off from the resisting portion 21 under a weakened force.

Optionally, the thumb portion 211 could be formed on a middle portion of the cantilevered beam 221. The resisting face 115 is formed in the inserting recess 122 in front of the thumb portion 211. The thumb portion 211 abuts against the resisting face 115.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a mating connector along a mating direction, comprising:

an insulative housing defining a passageway;

two latching members inserted in the passageway of the insulative housing, each of said latching members having a resisting portion and a latching portion extending forwardly from the resisting portion and deformable from a first position to a second position for latching with the mating connector, said resisting portion comprising an upper section and a lower section formed at opposite sides of the latching portion and respectively abutting against the insulative housing along the mating direction when the latching portion is located in the second position, and cable assembly carrying a plurality of contact terminals, said insulative housing defining an interfering hole, said lower section of the latching member comprising a body portion connected with the upper section and a barb portion secured in the interfering hole, said passageway of the insulative housing comprising a pair of securing recesses for insertion of the resisting portions of the two latching members and a pair of resisting faces respectively defined in the securing recesses, said resisting face disposed forwardly of the resisting portion and extending perpendicular to the mating direction, said resisting portion abutting against the resisting face when the latching portion is located in the second position, said passageway comprising a pair of inserting recesses each communicating with associated securing recess for insertion of the latching portion of the latching member, said insulative housing comprising a base portion and a tongue portion extending forwardly from the base portion and formed with a pair of ribs, said pair of securing recesses being defined at the base portion, said pair of inserting recesses being respectively defined in the pair of ribs, said tongue portion of the insulative housing defining a plurality of contact recesses for insertion of the contact terminals, said base portion of the insulative housing defining a plunging recess, said cable assembly comprising an organizer plunged in the plunging recess, and a cable having a plurality conductive portions electrically connected with said contact terminals in the organizer.

2. The electrical connector as claimed in claim 1, wherein said latching portion, the upper section and the body portion are combined as a T-shape.

3. The electrical connector as claimed in claim 1, wherein said barb portion of the latching member extends forwardly from substantially a middle portion of the body portion and substantially parallel with the latching portion.

4. The electrical connector as claimed in claim 1, further comprising an upper shielding shell formed with a pair of upper blocking plates, said upper section of the latching member being confined between the resisting face and the upper blocking plate.

5. The electrical connector as claimed in claim 1, further comprising a lower shielding shell formed with a pair of lower blocking plates, said body portion of the latching member being confined between the resisting face and the lower blocking plate.

6. The electrical connector as claimed in claim 1, wherein said latching portion of the latching member comprises a cantilevered beam cantilevered in the inserting recess, said cantilevered beam having a root portion connected with the resisting portion, and a hook portion opposite to the root portion and tilting outwardly from the inserting recess in the first position.

7. The electrical connector as claimed in claim 1, wherein said plunging recess of the base portion is formed with a block, and said organizer defines an opening engaging with the block.

8. A electrical connector comprising:

an insulative housing defining a mating port, along a front-to-back direction with, a latch-receiving passageway on a lateral side in a lateral direction perpendicular to said front-to-back direction;

a plurality of contacts disposed in the housing with contacting sections exposed in the mating port, each of said contacts defining an upper level where the contacting section is located and a lower level where a solder section thereof is located;

a latching member disposed in the passageway and defining a resisting portion with a deflectable latching portion forwardly extending from a middle section of the resisting portion, said resisting portion defining an upper section and a lower section located by two opposite sides of the middle section in a vertical direction perpendicular to both said front-to-back direction and said lateral direction, both said upper section and said lower section intimately forwardly confronting the housing for preventing forward movement of the latching member relative to the housing; and an organizer assembled to the housing in the vertical direction and abutting against said contact in both said upper level and said lower level.

* * * * *